US010036210B2

(12) United States Patent
Maclean et al.

(10) Patent No.: US 10,036,210 B2
(45) Date of Patent: Jul. 31, 2018

(54) METHOD AND SYSTEM FOR DEPLOYING AN ELECTRICAL SUBMERSIBLE PUMP IN A WELLBORE

(71) Applicant: ZiLift Holdings, Limited, Aberdeen (GB)

(72) Inventors: Iain Maclean, Aberdeen (GB); Kenneth J. Sears, Aberdeen (GB); Edwin Coutts, Stonehaven (GB)

(73) Assignee: ZiLift Holdings, Ltd., Aberdeen (GB)

( * ) Notice: Subject to any disclaimer, the term of this patent is extended or adjusted under 35 U.S.C. 154(b) by 246 days.

(21) Appl. No.: 14/701,567

(22) Filed: May 1, 2015

(65) Prior Publication Data

US 2016/0319607 A1 Nov. 3, 2016

(51) Int. Cl.
*E21B 17/00* (2006.01)
*E21B 19/22* (2006.01)
*E21B 43/12* (2006.01)

(52) U.S. Cl.
CPC ..... *E21B 17/003* (2013.01); *E21B 19/22* (2013.01); *E21B 43/128* (2013.01)

(58) Field of Classification Search
CPC ..... E21B 17/003; E21B 17/206; E21B 43/128
See application file for complete search history.

(56) References Cited

U.S. PATENT DOCUMENTS 3,758,699 A * 9/1973 Lusk ..... H02G 15/22 174/15.3
3,773,965 A * 11/1973 Reynolds ..... H01B 7/0233 174/102 SC
3,987,238 A * 10/1976 Reinke ..... H01B 7/29 165/179
4,456,946 A * 6/1984 Brower ..... H05K 3/325 362/13
4,639,609 A * 1/1987 Floyd ..... B60R 16/0315 307/10.1

(Continued)

FOREIGN PATENT DOCUMENTS

CN 203594386 U 5/2014
GB 2326526 A 12/1998

OTHER PUBLICATIONS

International Search Report and Written Opinion. International Application No. PCT/GB2016/051189.

*Primary Examiner* — D. Andrews
*Assistant Examiner* — Jonathan Malikasim
(74) *Attorney, Agent, or Firm* — Richard A. Fagin

(57) ABSTRACT

A method for deploying a pump system in a wellbore includes coupling the pump system to one end of a tubing encapsulated cable. The cable is extended into a wellbore drilled through a subsurface fluid producing formation. The tubing encapsulated cable has an outer tube extending substantially continuously from the end thereof connected to the pump system to a surface end of the cable. The outer tube is made from material selected to exclude fluid in the wellbore from an interior of the outer tube. The cable includes at least one electrical conductor disposed inside the outer tube, wherein a rated load current of the at least one electrical conductor is selected such that substantially continuous electrical current drawn by the electrical load device exceeds the rated current of the at least one electrical conductor.

26 Claims, 3 Drawing Sheets

(56) References Cited

U.S. PATENT DOCUMENTS

| | | | | |
|---|---|---|---|---|
| 5,119,054 | A * | 6/1992 | Grunert | H01H 71/2481 335/21 |
| 5,469,925 | A * | 11/1995 | Mueller | E21B 7/061 175/61 |
| 6,192,983 | B1 | 2/2001 | Neuroth et al. | |
| 6,285,014 | B1 * | 9/2001 | Beck | E21B 36/04 166/248 |
| 7,606,014 | B2 * | 10/2009 | Ziegler | H01R 13/6666 361/115 |
| 8,847,069 | B2 * | 9/2014 | Emme | H01B 7/423 174/15.1 |
| 8,925,627 | B2 * | 1/2015 | Tupper | E21B 17/20 166/302 |
| 2006/0201278 | A1 * | 9/2006 | Pizzichil | F16H 57/033 74/640 |
| 2012/0292051 | A1 | 11/2012 | Wetzel et al. | |
| 2013/0236332 | A1 * | 9/2013 | Frey | F04B 17/03 417/313 |
| 2014/0076597 | A1 * | 3/2014 | Patel | H01B 3/445 174/37 |
| 2014/0190706 | A1 | 7/2014 | Varkey et al. | |

* cited by examiner

METHOD AND SYSTEM FOR DEPLOYING AN ELECTRICAL SUBMERSIBLE PUMP IN A WELLBORE

BACKGROUND

This disclosure is related to the field of electrical submersible pumps, (ESP) pump systems and methods for deployment of such pump systems in subsurface wells. More specifically, the disclosure relates to ESP deployment using an innovative arrangement where power is supplied to an ESP system using a tubing encapsulated cable (TEC) cable disposed in the ESP discharge fluid where the TEC is purposely operated at higher current densities than according to accepted electrical cable selection practices to minimize cable diameter, weight, cost, size of cable spooling equipment, complexity of the completion and subsequent capital costs.

The use of electric submersible pumps (ESPs) is well known to be advantageous in artificial lift of oil and gas from wellbores and for removing water (dewatering) gas wells, among other uses. Methods for deployment of ESPs, for example, on a small diameter threadedly connected jointed tubing (a conduit having a relatively small diameter to increase velocity of produced fluids to surface), requires the use of wellbore pipe lifting equipment such as a workover rig, and the cost of deployment can be significant, which in the case of smaller wells may inhibit exploitation of resources.

Part 'rigless' ESP deployment methods have been developed, including those using a downhole "wet" connect such that the ESP maybe deployed on a non-electrical cable and making electrical connection downhole using a special connector previously installed on the wellbore tubing, but such methods still require the tubing to be specially fitted out. Such fitment requires the use of a workover or other rig to prepare the well as does any failure of the downhole "wet" connect, cable and wellhead penetrator.

Deployment of retrofit ESPs on the power supply cable is believed to be desirable, however, such deployment has proven to be impractical using conventional ESPs and ESP cable, e.g., externally armored electrical cable. The ESP power supply cable transmits the required electrical power from a power supply to the ESP motor(s) disposed in a wellbore. ESP power supply cable is typically a specially constructed three-phase power cable designed specifically for use in subsurface well environments. The ESP power supply cable in ESP deployment methods and systems known in the art is banded or clamped to the exterior of the production tubing from below a surface control valve assembly coupled to the top of the well casing and production tubing (the "wellhead") to the ESP system. Such cable is not designed to support its own weight.

A cable to be used for deployment of an ESP system must have adequate tensile strength to support its own weight, the weight of the ESP system, an allowance for overpull (tension applied to the cable in excess of the cable rated operating tension limit based on weight and depth plus the ESP system weight resulting from friction and other means by which the cable and ESP become lodged in the wellbore) and a safety factor.

Electrical conductor size in an ESP electrical power cable has a substantial effect on the external dimensions of the cable, the weight of the cable and its cost. The electrical conductor size is selected using design principles known in the art by determining the total amount of electrical current required to operate the motor(s) and any other electrically operated components of the ESP system substantially continuously, and using electrical equipment industry standard reference tables (examples set forth below) to select the appropriate electrical conductor size from among what are usually standard size electrical conductors. Typically the electrical conductor size is based on full load ESP motor running current, however, ESPs typically use induction motors in which case the motor starting current may be a factor of considerable significance in selection of the current carrying capacity (and resulting size) of the electrical power supply cable conductors.

One factor which is considered important in generating the above described industry standard reference tables for electrical conductors is to restrict electrical power losses in the cable due to electrical resistance. The normally accepted range is to restrict losses to the order of 2% to 5% of the amount of power supplied from the surface. One accepted standard is API Standard Recommended Practice (RP) 11S4, published by the American Petroleum Institute, Washington, D.C. API RP 11S4, which provides that a maximum of 5% voltage drop over the entire length of the cable from the power supply to the ESP will provide a reasonable operating efficiency. The voltage drop is related to the length of the cable, i.e., its depth in the wellbore, the resistance per unit length of the cable conductors and the total current drawn by the ESP system (whether at full running load or at starting load current). In conventional ESP installations, with a fixed, or limited voltage at surface, a long cable may cause such a voltage drop in the cable that there is insufficient voltage at the motor. Therefore, a larger conductor would be chosen. With a transformer in the surface electrical supply, the voltage at the surface end of the cable may be increased to compensate for the cable voltage drop, to retain adequate voltage at the motor. Therefore, the 5% voltage drop need not be a limiting factor.

In addition to power loss between the power supply and the ESP, which requires additional power from the surface power supply to provide the required electrical power at the ESP system, resistive losses cause heating of the electrical power supply cable. Excessive heating can cause the cable to deteriorate and eventually become unserviceable. To determine the allowable conductor temperature in its application, a power cable "ampacity" chart may be used (ampacity means ampere capacity, and is related to cable temperature).

IEEE Standard 1018-2013 'Recommended Practice for Specifying Electric Submersible Pump Cable—Ethylene-Propylene Rubber Insulation' published by IEEE, 3 Park Avenue, N.Y. 10016-5997 U.S.A. provides guidance to determine the ampacity of an electrical cable for ESP use and includes standard reference tables.

Furthermore, because of the high cost of cable and installation, it is usual for the electrical cable conductor specification to be very conservative, that is, the electrical cable is selected to have a substantially greater ampacity than would otherwise be sufficient to carry the required electrical power to the ESP system from the surface. API RP 11S4 notes that using larger conductors will improve cable life by reducing internal heating caused by electrical current flowing in the cable.

The foregoing considerations may result in specification of a cable which is relatively large, complex, heavy and expensive. To provide abrasion resistance and tensile strength, electrical power cables known in the art have a plurality of small diameter steel or other high strength metal wire armor helically wound around the exterior of the cable. Such armor may limit the minimum allowable bend radius of the electrical power cable and may complicate sealing the electrical power cable where it passes through valves and related apparatus at the surface end of the wellbore (the "wellhead") for connection to the surface power supply and related control system. To provide additional protection, some armored electrical cables include lead sheathing, for example, as explained in U.S. Pat. No. 5,414,217 issued to Neuroth et al. An electrical power cable with these characteristics is believed not to be suitable for use in connection with deployment apparatus such as the use of "wireline" well intervention and surveying equipment (including winches and pressure seals enabling the wireline to pass through the wellhead while maintaining a pressure tight seal).

Many devices are known in the art which address different aspects of the requirements of wellbore deployed electrical cables. For example, U.S. Pat. No. 5,086,196 issued to Brookbank et al. explains by way of background that cable-suspended ESP systems known prior to such patent require a specially constructed cable because conventional three-phase electrical power cable lacks sufficient tensile strength to support the weight of the ESP system. Such ESP electrical power cables known in the art prior to the present disclosure may have structural supporting members, as well as electrical conductors. Some of the electrical power cables known in the art were difficult to use and maintain because of the complexity of the cable construction, difficulty in splicing, and the tendency of the cable to rupture under gas depressurization. Early efforts in deploying ESP systems on an electrical power supply cable often resulted in cable failures and abandonment. More recently designed suspended electrical power supply cables have an even more complex cable utilizing molded vertebrae.

A further consideration concerns deployment of electrical apparatus such as a wellbore pump system into a "live" wellbore, that is, a wellbore in fluid communication with a fluid producing subsurface formation. At the surface connection (wellhead) in such wellbores, an electrical power cable is subject to a force which is related to the product of the wellbore fluid pressure at the wellhead and the cross sectional area of the wellbore power cable. Special measures have to be taken to withstand the forces resultant from the wellbore fluid pressure acting on the relatively large size of a conventional electrical cable, which may increase the cost and complexity of the installation.

Another problem encountered when using electrical cable for deployment of ESP systems is gas embolism due to rapid decompression of the cable after gases have dissolved in elastomeric materials used in the construction of the power cable. Rapid decompression may occur when the power cable is withdrawn from a well having substantial fluid pressure therein. One technique known in the art for addressing the embolism problem is to envelop the insulated electrical conductors of the power cable in a braid consisting of two layers of interwoven galvanized steel wires. Such cable construction has proven susceptible to kinking caused by thermal expansion of elastomeric electrical insulation and jacket material interacting with steel armor wires that surround the braid.

The Brookbank et al. '196 patent addresses another concern with wellbore-deployed electrical power cables, and describes an electro-mechanical cable for use in cable deployed pumping system which includes a containment layer surrounding a cable core and constructed to restrain outward radial expansion of the core while permitting longitudinal expansion.

There have been other approaches to simplify construction of an electrical power cable for use in a subsurface wellbore. For example, U.S. Pat. No. 4,928,771 issued to Vandevier discloses a system in which single-phase AC power is supplied from the surface along an insulated electrical conductor, with current return being along a wellbore casing. A phase converter converts the single-phase AC power to three-phase AC power downhole for driving the pump motor. This simplifies the cable, but requires downhole power electronics, which adds complication and risk of unreliability.

None of the foregoing electrical cables are designed for ESP system deployment using "wireline" winch equipment as they may have the following properties making them unsuitable for such deployment: the cables may be too heavy for a typical wireline unit winch; smaller, lighter cables may have insufficient tensile strength to carry the required load (cable weight, plus pump system weight, plus moving friction loss, plus tension changes due to tool manipulations in the wellbore); the minimum bend radius of cables having sufficient tensile strength may be too large for a typical wireline winch drum; and the minimum outer diameter of such cables may be too large to enable movement of the ESP system into a wellbore having fluid pressure at the surface when the wellbore is static (not flowing fluid). "Wireline" winch equipment is known in the art for deploying measurement and other types of electrically operated well intervention devices into subsurface wellbores at the end of an armored electrical cable. External diameters of such externally armored cables may be in a range of about 0.1 inches (6 mm) to about 0.5 inches (13 mm). Further, armored electrical cables known in the art including helically wound external armor wires necessarily have a rough exterior surface by reason such armor wires on the exterior surface, thus making them possibly unsuitable to make a long term wellhead pressure barrier which is required for a pump deployment.

This invention to deploy an electrical submersible pump using tubing encapsulated cable will overcome the difficulties explained above.

DETAILED DESCRIPTION

Figure 1:
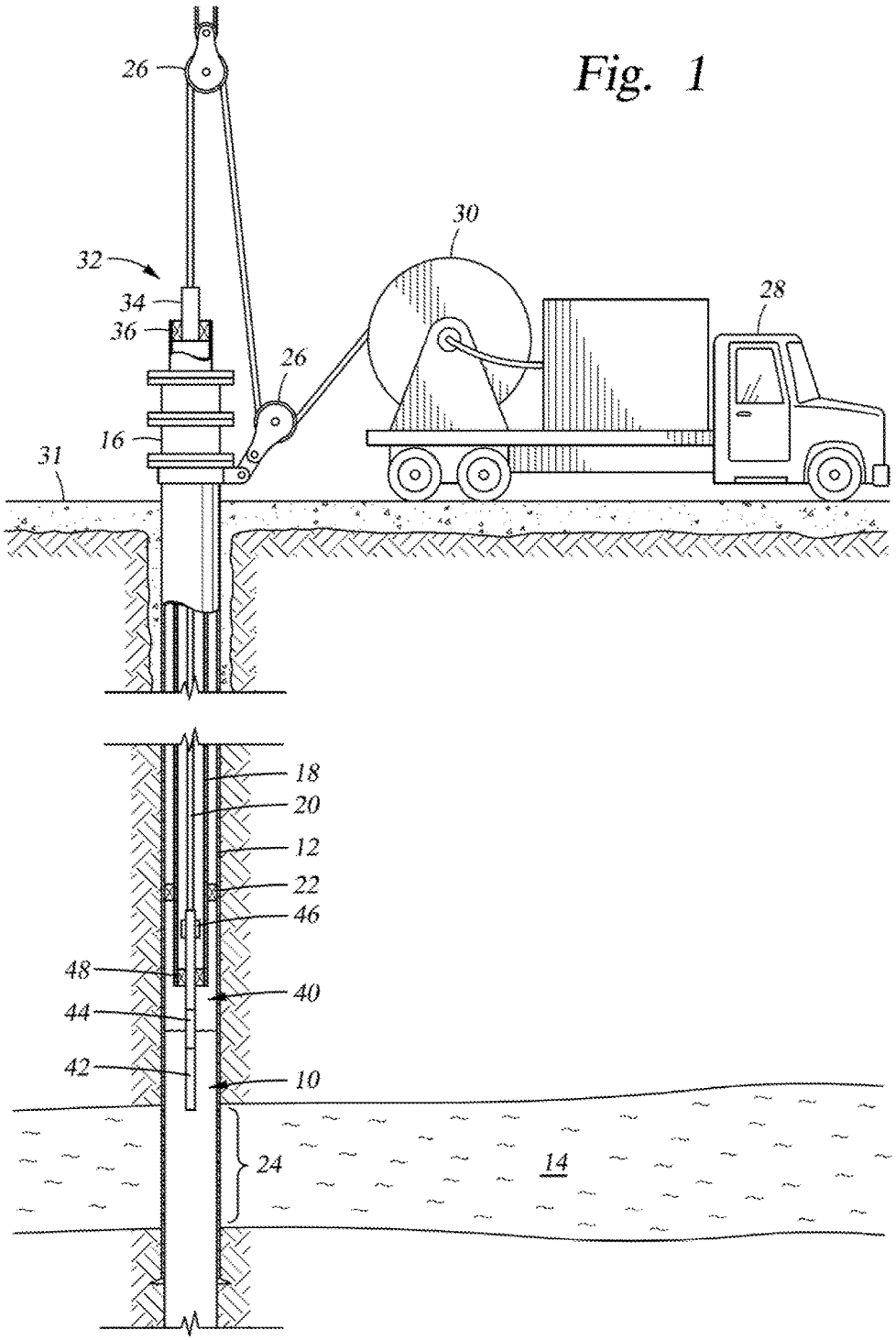
FIG. 1 shows an example embodiment of deploying an electric submersible pump (ESP) system using a tubing encapsulated cable (TEC) winched into a subsurface wellbore by a wireline winch unit.

1. General Principles of Deployment and Operation of a Wellbore Pump System

Deployment methods and apparatus according to the present disclosure are applicable to an electrical load device including but not limited to wellbore fluid pumps driven by permanent magnet electric motors. Deployment methods and apparatus according to the present disclosure may be advantageous for wellbore fluid pumps which operate at higher rotational speed than typical wellbore fluid pump speed of approximately 3600 revolutions per minute (RPM).

Permanent magnet electric motors may have advantages over conventional induction motors typically used with wellbore fluid pumps including, without limitation, more power generated for a particular size (diameter) of motor, greater motor electrical efficiency, no requirement for a motor starting current substantially greater than the motor running current and better suitability for higher rotational speeds. With appropriate design, all the foregoing features may enable a smaller, lighter wellbore fluid pump assembly to be produced for any particular fluid pumping rate requirement. Using permanent magnet motors in a wellbore pump system may as a result require less electrical current to operate as compared with induction motor type wellbore pump systems.

In order to minimize the weight, size and cost of an electrical cable used to deploy a wellbore pump according to the present disclosure, an electric motor used to drive the pump may be operated at a higher electrical voltage than is conventional for wellbore ESP systems. Electrical power is the product of current and voltage, so a required electrical power may be delivered at lower current if a higher voltage is used. Lower current reduces the required conductor size.

When a wellbore pump system is sufficiently light weight, a cable may be used to deploy the pump system in a subsurface wellbore. Such a cable may be smaller in diameter and lighter than ESP power cables known in the art and may have a different construction than ESP power cables known in the art. Such a cable construction may enable different scale of surface equipment to be used with significant advantages in cost and operational practicality. For example, a winch system used to deploy electric "wireline" measuring and/or intervention instruments into a subsurface wellbore may be used to deploy a wellbore pump system.

In methods and systems according to the present disclosure, in order to enable the benefits of deployment on a different construction of cable to be realized, the cable conductors may be deliberately undersized. That is to say the electrical conductors in the cable may have a rated current carrying capacity below the continuous electrical current drawn by the pump motor than that understood by those skilled in the art to be considered acceptable design practice for continuous operation of wellbore deployed electrical load devices. Using electrical conductors to carry current greater than the rated current for periods of limited, controlled duration is known in the art. See, for example U.S. Patent Application Publication No. 2013/0214928 filed by Kuittinen et al., however, continuous use of electrical conductors above their rated current carrying capacity is not known.

The relatively light weight of electrical load devices such as a wellbore pump system, and the relatively light weight of the electrical power cable itself which results from using under-sized electrical conductors (as compared to accepted design practice). Under-sized electrical conductors in the present context means electrical conductors having a cross sectional area smaller than that used for a selected amount of electric current according to accepted design practices. Using under-sized (or, conversely, overloaded) electrical conductors may enable the tensile capacity of the electrical power cable to be reduced as contrasted with wellbore pumps and cables known in the art because of the lighter weight of such intentionally overloaded electrical cable.

The electrical load device, e.g., an electrical pump system deployment and electrical power cable according to the present disclosure may be or include a tubing encapsulated cable ("TEC"). The TEC may include one or more electrical conductors which are individually electrically insulated. The electrical conductors and associated insulation layers may be surrounded by an encapsulating tubing. The encapsulating tubing may provide an impermeable barrier to protect the one or more electrical conductors and insulation from well fluid. TEC as used in various example embodiments herein is distinguishable from coiled tubing having electrical conductors associated therewith by reason of the encapsulating tubing being arranged to exclude entry of any fluid to an interior space inside the tubing. See, for example, U.S. Pat. No. 5,285,008 issued to Sas-Jaworsky for a description of coiled tubing having electrical conductors therein. Such coiled tubing has an internal conduit that may be used as a fluid conduit to move fluid from a surface end thereof into a wellbore and/or from the interior of a wellbore to the surface end of the coiled tubing. TEC as used herein does not include such fluid conduit.

An additional distinguishing feature is that coiled tubing is known in the industry in sizes from 0.75 inch outer diameter to 4.5 inch outer diameter, with common sizes in use being about 2 inches outer diameter. In examples where electrical cable is introduced into the coiled tubing, the electrical cable does not fill the entire inner volume of the coiled tubing, and a fluid or expandable material may be introduced into the remaining void, or alternatively, the void may be left unfilled. See for example, U.S. Patent Application Publication No. 2014/0190706 filed by Varkey et al. The term "tubing encapsulated cable" as used in this disclosure is used to mean a cable construction in which a smooth wall, hollow core tubing is closely fitted to the exterior of electrical insulation on one or more electrical conductors enclosed in the tubing during the manufacturing process of the electrical cable.

The encapsulating tubing in the TEC may be made from stainless steel, an alloy sold under the trademark INCONEL (a registered trademark of Huntington Alloys Corporation, Huntington, W. Va.) or other substantially fluid impermeable material. The encapsulating material may be selected to provide substantial tensile strength to the TEC, and may provide a substantially smooth exterior surface which improves sealing when passed through pressure sealing equipment disposed at the earth's surface (at the "wellhead") during deployment, retrieval, and during fluid production from the subsurface by operation of the wellbore pump system.

The encapsulating tubing of the TEC is widely available in a range of materials, external diameters and wall thicknesses enabling construction of an efficient, low cost electrical power cable.

The electrical power cable may have one or more non-circular cross-section electrical conductors which may enable the overall size of the cable to be minimized with respect to the electrical conductor cross sectional area. Such relatively small size of the electrical power cable may enable the power cable to have a smaller minimum bend radius, which may facilitate handling at the surface by simple, lightweight winch equipment, for example of the type used for wireline operations as described above.

Smaller cross sectional area of the electrical power cable may facilitate deployment of a wellbore pump system into a "live" wellbore, that is, a wellbore in fluid communication with a fluid producing subsurface formation. In such wellbores, an electrical power cable is subject to a force which is related to the product of the wellbore fluid pressure at the wellhead and the cross sectional area of the wellbore power cable. For example, a 0.375 inch (approx. 9.5 mm) outer diameter electrical power cable made according to the present disclosure has a cross sectional area of about 0.11 square inches (approx. 71 $mm^2$), as contrasted with a typical wellbore pump system cable known in the art having 1 inch (25 mm) diameter. The cross sectional area of such typical electrical power cable known in the art is about 0.786 square inches (507 $mm^2$), or about seven times greater than the cross sectional area of a TEC sized according to the present disclosure. Smaller diameter electrical power cable may enable the wellbore pump system to be deployed by extending the electrical power cable with the pump system at an end thereof to move into a pressurized wellbore under its own weight. Conveyance of a wellbore pump system using larger external diameter power cable as in the example above may require additional surface equipment, such as an injector unit, to urge the suspended wellbore pump system and electrical power cable into the well against wellhead pressure.

The electrical conductor size (and corresponding current carrying capacity) of the electrical conductors in the electrical power cable is determined by the substantially continuous electrical current to be carried along the electrical cable, and a rating factor which is used. In methods and systems according to the present disclosure, the electrical current required to operate an electric motor in wellbore pump system may be reduced by use of permanent magnet motor as contrasted with an induction motor. The electrical conductor size may be further reduced by using a smaller size electrical conductor than would be specified according to design principles known in the art. Such design principles are described, for example, in published standards API RP 11S4 set forth in the Background section herein and in the Institute of Electrical and Electronics Engineers (IEEE) standard 1018. The foregoing standards are related to:

a) minimizing cable power losses and therefore operating costs'
b) managing heat rise in the cable (especially in the dry annulus portion) and its impact on dielectric deterioration due to higher temperatures' and
c) enabling acceptable motor starting torque where a deep installation with high cable power losses would create low voltage to the motor and therefore low motor starting torque. Prior to the use of variable speed drives (VSDs) ESPs were started 'direct on line' and voltage drop along the power cable could prevent ESP motors from starting reliably.

The dissipation of electrical energy by resistive heating is often undesired, particularly in the case of electrical power transmission losses in power lines and power cables. Using increased voltage and lower current may reduce the resistive power loss by reducing the current for any selected amount of electrical power.

Resistive heating is related to the power and current transmitted along a power cable by the expression $P=I^2R$ where P represents the electrical power (energy per unit time) converted from electrical energy to thermal energy, R is the resistance of the power cable, and I is the current flowing through the resistance R. It is conventional practice, as may be inferred from the above two industry standards for conductor size selection, to minimise resistance, preferably to the point where no effect from heating is apparent.

In methods and systems according to the present disclosure, the current carried by the electrical power cable may be reduced by using a higher than ordinary voltage to transmit the required electrical power than is typically used for wellbore pump systems. In some embodiments, the voltage may be at least 600 volts. In some embodiments, the voltage may be at least 3,000 volts.

In methods and systems according to the present disclosure, the current carrying capacity of the electrical cable as determined by standards such as the API 11 S4 standard referred to above ("the rated current" of the electrical power cable) may be intentionally selected to be smaller than the continuous current passed through the electrical cable to operate the electric motor of the wellbore pump system. In some embodiments, the current passed through the electrical power cable to operate the wellbore pump motor substantially continuously ("motor current") may be at least 125 percent of the rated current. In some embodiments, the motor current may be at least 150 percent of the rated current. In some embodiments, the motor current may be at least 200 percent of the rated current. In some embodiments, the motor current may be at least 300 percent of the rated current. The motor current in any particular embodiment may exceed the rated current by an amount related to the temperature of fluid entering the well bore from a fluid producing formation, the heat capacity of the fluid and a flow velocity of the fluid as it moves to the surface when the wellbore pump system is operating. In the present context, "substantially continuously" means the steady state current, i.e., excluding starting transient current, during times when the well operator desires to use the wellbore pump system to move fluid from the subsurface to the surface, the wellbore pump system is operated substantially continuously (i.e., is operating substantially all the time during such periods of time). As will be appreciated by those skilled in the art, the times at which the wellbore operator may desire to operate the wellbore pump system may be related to the fluid pressure and permeability of a subsurface formation, the vertical depth of the formation and the overall specific gravity of the fluid produced from the subsurface formation. Some well bore pump systems may include automatic devices, to be further explained below, that can switch the wellbore pump system on and off based on measurements of liquid level in the wellbore to avoid "pump off", wherein the wellbore pump system pumps fluid to the surface faster than an inflow rate from the subsurface formation and consequent drop in liquid level in the well bore.

In one example embodiment, a wellbore pump system may have an electric motor that draws current that would require American Wire Gauge (AWG) 8 sized electrical conductors if the API 11S4 standard is followed. In such example embodiment, AWG 12 electrical conductors may be used in a TEC. Using such size electrical conductors it is possible to deploy the wellbore pump system using 0.375 inch (9.5 mm) outer diameter (OD) tubing in the TEC. TECs having such OD tubing and size electrical conductors may be obtained from Draka Cableteq USA, Inc., 22 Joseph E/Warner Blvd., North Dighton, Mass. 02764. A 48 inch (1219 millimeter) diameter sheave is recommended for such OD tubing. Such bend radius is readily accommodated by wireline winch equipment as described herein above.

In embodiments of a method and system according to the present disclosure, what would ordinarily be considered excessive resistive heating loss in the power cable is accepted and allowed for in calculations of electrical efficiency for the wellbore pump system. In embodiments of a method and system according to the present disclosure, because the wellbore pump system is deployed into the wellbore at the end of the TEC-type electrical power cable, the electrical power cable is immersed in flowing well fluid, which may cool the electrical power cable so as to avoid failure of the electrical power cable and/or heat sensitive parts of the electrical power cable such as the electrical insulation for the electrical conductors. In one example embodiment where a wellbore pump is disposed at a wellbore (measured) depth of about 5,000 feet (1524 meters):

| a. Industry standard (e.g., IEEE 1018): 8 AWG (0.1285 inch (3.26 mm) diameter) | |
|---|---|
| Resistance | 0.6282 ohms/1000 feet (305 meters) |
| Rated current | 24 amperes (2.9 A/mm$^2$) |
| Voltage drop at 24 amperes along 5000 feet (1524 m) | 175 volts. |

| b. Using an intentional above rated current density in smaller electrical conductors: 12 AWG (0.0808 inch (2.05 mm) diameter) | |
|---|---|
| Resistance | 1.588 Ohms/1000 feet (305 meters) |
| Rated current | 9.3 amperes (2.8 A/mm$^2$) |
| Voltage drop at 24 amperes along 5000 feet (1524 m) | 442 volts. |

According to accepted electrical design practices such as the IEEE 1018 standard referred to above, a continuous current drawn by an example ESP system of 24 amperes would require 8 AWG electrical conductors. The increased voltage drop and higher resistive heating if the described 12 AWG electrical conductors were used over the same length of electrical power cable would be considered contrary to accepted design practice. Resistive heating effect using the smaller (12 AWG) electrical conductor would be expected to be about 2.5 times that of the larger (8 AWG) electrical conductors for the example current and cable length shown. However, in the embodiments disclosed herein, the cable is cooled by the produced fluid flowing in contact with the cable for the entire length of the cable from the motor to surface, which provides substantially greater cooling than is considered to be safe, which consideration is based on at least part of the cable being surrounded by a gaseous (non-liquid) medium. The use of substantially smaller cross-section electrical conductors thereby enables the cable to be constructed as tubing encapsulated cable which further enables the advantageous deployment method using the described lightweight surface equipment. In some embodiments, 10 AWG (0.1019 inch diameter) electrical conductors may be used.

For a large, powerful pump system, the operational cost of increased electrical power losses in the cable due to current density (electrical current per unit of cross sectional area of the cable conductors) would be unacceptable, and the additional heating effect would not be manageable. In any case, simply reducing the size of a large cable is of limited value, as the deployment method would remain unchanged. However, in certain smaller systems where the combination of lower power (HP) and low current (due to higher voltage) the magnitude of the losses may be very much smaller, reducing the cost in absolute terms (as compared to as a percentage) and the system can be designed to accept these inefficiencies, which allows TEC cable to be used with the resulting benefits of the present example deployment method, by eliminating the requirement for workover rigs.

The rotation speed of a permanent magnet AC electric motor is related to the frequency of the AC power supplied to the motor. The voltage required to operate such motors is related to the frequency in the general form of a predetermined relationship between voltage and frequency. In some embodiments a surface-deployed variable-frequency electrical power source with a step-up output transformer may be used to provide controllable frequency and voltage to drive the electric motor. Using such a power source with a step-up transformer, the power source output voltage may be further increased by appropriate design of the transformer to provide for the additional voltage drop over any selected cable length of electrical power cable operated with enhanced current density, and so ensure adequate voltage at the electric motor used to drive the wellbore pump.

In one example embodiment the encapsulating tubing in a TEC may be made from alloy 316 stainless steel. In such example embodiment, the encapsulating tubing may be a standard size, for example, 0.375 inches (9.5 mm) OD and have a wall thickness of 0.049 inches (1.25 mm). Such tubing has a rated working tensile capacity of approximately 5000 pounds force (22241 N). In some embodiments a safety margin of twenty percent of the rated working tensile capacity of the encapsulating tubing allows 4000 pounds force (17993 N) safe working tensile force to be applied to the TEC. In some embodiments, similar dimension encapsulating tubing made from the above described INCONEL alloy may be used, which would increase the above stated safe and maximum tensile capacities of the TEC by about twenty percent. In the present example embodiment, the wellbore pump system may have a maximum outer diameter (OD) of 3.5 inches (89 millimeters) and may have a weight of about 950 pounds (430 kg). 5000 feet (1524 meters) length of the above described 316 stainless steel alloy tubing having three 12 AWG insulated electrical conductors therein extended into a substantially vertical wellbore has a weight at the ground surface of about 250 pounds per 1000 feet (113 kg per 304.8 meters) which results in a total weight of 2196 pounds (996 kg) for the pump system plus TEC in the present example. Thus, the disclosed TEC using three insulated 12 AWG copper conductors is strong enough to support the weight of the TEC and the wellbore pump system while enabling sufficient electrical power to reach the electric motor in the wellbore pump system substantially continuously.

TEC has been developed to withstand conditions in many subsurface wellbore, including immersion in well fluid at pressures up to 20,000 pounds per square inch (13,790 kPa), at temperatures of up to 300° C. using the above described dimension 316 alloy stainless steel TEC and suitable electrical insulating material. It has been determined that the electrical conductors in such TEC may be safely operated substantially continuously at current more than 300 percent of the rated current without failure when the TEC is submerged in flowing wellbore fluid moved to the surface by the wellbore pump system.

The overload of the electrical conductors in the TEC may also be defined in terms of substantially continuous load current per unit cross-sectional area of the electrical conductors. In some embodiments, the substantially continuous electrical current drawn by the electrical load device is at least 6 amperes per square millimeter of conductor cross section area. In some embodiments, the substantially continuous electrical current drawn by the electrical load device is at least 10 amperes per square millimeter of conductor cross section area.

Possible benefits of deploying an electrical apparatus such as a wellbore pump system on TEC according to the present disclosure may include one or more of the following. First, a wireline instrument type winch may provide the required cable transportation and deployment capacity. The TEC may have an external diameter selected to have a minimum bend radius small enough to fit on a wireline instrument type winch drum. The TEC may be readily inserted into and withdrawn from a wellbore through well-known wireline pressure control apparatus.

Wireline-type wellbore pressure control apparatus may be readily adapted for use with smooth-surface TEC with few if any modifications, further reducing the complexity and cost of a wellbore pump system installation, operation and removal for service and/or replacement.

The benefits that may be obtained using wellbore pump system and deployment methods according to the present disclosure may include ease of deployment which results from the use of lightweight TEC. Such benefit may outweigh the cost of reduced electrical efficiency resulting from power loss along the TEC when electrical conductors are operated above their rated current. The foregoing is counter to the accepted practice for determining electrical power cable specifications. Being able to use smaller, less costly deployment apparatus, e.g., wireline wellbore instrument winch systems, may allow the present example methods of deployment to be used economically on wells that would otherwise be economically non-viable.

2. Example Embodiments

Having explained in general terms how to select dimensions of a TEC for deployment and operation of a wellbore pump system according to the present disclosure, example embodiments will now be described with reference to the various figures.

FIG. 1 shows an example wellbore 10 drilled through subsurface formations including a producing formation 14. The producing formation 14 may have hydrocarbons and water therein and when a pressure in the wellbore 10 is lower than the fluid pressure in the producing formation 14 hydrocarbons and water in various amounts may produce into the wellbore 10. The wellbore 10 may have cemented in place therein a protective pipe or casing 12 that extends from a wellhead 16 at the surface 31. A length of smaller diameter pipe or "tubing" 18 may extend from the wellhead 16 to a selected depth in the wellbore 10, typically, although not necessarily above the depth of the producing formation 14. The tubing 18 may be provided to increase the velocity of fluid moved from the producing formation 14 to the wellhead 16. An annular space between the tubing 18 and the casing 12 may be closed to fluid communication by an annular seal or packer 22. The casing 12 may include perforations 24 therein at a depth corresponding to the depth of the producing formation 14.

An electrical load device, which in the present example embodiment may be a wellbore pump system 40 may be connected to one end of a tubing encapsulated cable (TEC) 20. The wellbore pump system 40 may include a high speed, permanent magnet AC electric motor 44 coupled to a pump 42 such as a centrifugal pump. The permanent magnet AC electric motor 44 may be configured to operate at high rotational speeds, for example, at least 5,400 revolutions per minute (RPM). The pump 42 may be configured correspondingly to operate at such rotational speed. In some embodiments, the wellbore pump system 40 may include any suitable seal element, for example, a remotely controllable, inflatable annular seal 48 to close off fluid communication between an inlet of the pump 42 and a pump fluid discharge 46 disposed in the tubing 18. In other embodiments the annular seal 48 may already be in place in the tubing 18 or in the casing 12. In other embodiments, the tubing 18 may not be used; the wellbore 10 may be completed using only a casing. As explained above, in some embodiments, the wellbore pump system 40 may have a maximum OD of 3.5 inches (89 mm). Also as explained above, in some embodiments, the TEC 20 may have a maximum outer diameter of 0.375 inches (9.5 mm). Various example connections between the wellbore pump system 40 and the TEC 10 will be further explained with reference to FIGS. 3-6.

In other embodiments, the TEC 20 may have a maximum outer diameter of 0.55 inches (approx. 14 mm).

In other embodiments, the pump 42 may be a positive displacement pump. In other embodiments, the pump 42 may be a progressive cavity pump.

The TEC 20 may be stored on and deployed from a wireline winch 30. The wireline winch 30 may be mounted on a vehicle 28 for on road transportation. In other embodiment the winch 30 may be a "skid" mounted unit for use on offshore well service units. The TEC 20 may be extended into the wellbore 10 through suitably positioned sheave wheels 26 positioned as would ordinarily be used in deployment of wireline wellbore measuring instruments or intervention instruments.

A wireline pressure control head 32 may be coupled to the top of the wellhead 16. A wireline pressure control head 32 may be as known in the industry as a stuffing box. The wireline pressure control head 32 may include an hydraulically compressible seal element 34 disposed in a bladder 36. The bladder 36 may be inflated by hydraulic pressure using equipment (not shown) known in the art for such purpose. The seal element 34 may have an internal opening sized to seal on an exterior surface of the TEC 20 to substantially prevent escape of fluid under pressure as the wellbore pump system 40 and the TEC 20 are extended into the wellbore 10 or withdrawn from the wellbore 10. The seal element 34 may also substantially prevent fluid from escaping around the exterior of the TEC 20 during operation of the wellbore pump system 40.

Figure 2A:
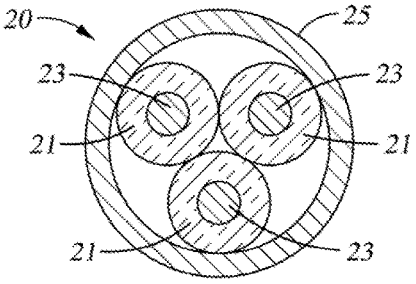
FIGS. 2A and 2B show example embodiments of a tubing encapsulated cable.

FIG. 2A shows one example embodiment of a TEC 20 according to the present disclosure. The TEC 20 may consist of a substantially continuous length outer tube 25 made from materials and having dimensions as explained above and having one or more insulated electrical conductors 23 disposed within the outer tube 25. In the present embodiment three electrical conductors 23 each covered by a layer of insulation 21 may be disposed inside the outer tube 25. In the present example embodiment, the outer tube 25 may be connected to an upper part of the wellbore pump system (40 in FIG. 1) so as to exclude entry of any fluid in the wellbore (10 in FIG. 1) from the interior of the outer tube 25. In the example embodiment shown in FIG. 2A, the electrical conductors 23 have a circular cross section, as do their respective insulation layers 21.

Figure 2B:
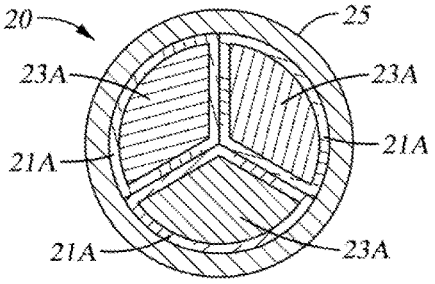

In another example embodiment shown in FIG. 2B, the electrical conductors 23A and respective insulation layers 21A may have non-circular cross-section, e.g., circumferential segments, to enable the electrical conductors 23A to occupy more of the interior cross-section of the outer tube 25.

The foregoing examples of TEC having three insulated electrical conductors are not intended to limit the scope of the present disclosure. In other example embodiments, the TEC may have more or fewer electrical conductors, and may include one or more optical fibers. In some embodiments, the TEC may have only one insulated electrical conductor inside the outer tube and may use the outer tube as an electrical conductor if it is made from electrically conductive material. In embodiments such as shown in FIG. 2B, the cross-sectional area of a non-circular cross-section electrical conductor may be equivalent to that of a round cross-section electrical conductor for purposes of selecting a cross-sectional area. As explained above, such cross-sectional area may be selected such that a substantially continuous electrical current drawn by the electric motor (44 in FIG. 1) is at least 125% of the rated current of the electrical conductor. In other embodiments, the cross-sectional area may be selected such that the continuous motor current exceeds the rated current of the electrical conductor(s) by an amount related to the length of the TEC from the surface to an axial position (wellbore depth) of the pump system, the temperature of fluid entering the wellbore from the producing formation and a velocity of fluid moving to surface from the producing formation. It has been demonstrated by testing that substantially continuous current drawn by the electric motor (44 in FIG. 1) may be as much as 300 percent of the rated current capacity of the electrical conductors in the TEC (20 in FIG. 1).

It is within the scope of the present disclosure to select a cross sectional area of one or more electrical conductors in a TEC such that the substantially continuous electrical current drawn by an electrically operated apparatus, e.g., an ESP system, is such that if the TEC were disposed entirely in air an increase in temperature of the one or more electrical conductors would be sufficient to result in one or more of the following adverse effects. First, the electrical conductors would have their elastic limit drops below the tensile stress applied thereto by reason of deployment of the TEC in a wellbore with an electrical apparatus at an end of the TEC. Second, electrical insulation on the electrical conductors would be subject to heat induced failure. Finally, the one or more electrical conductors would be subject to temperature induced oxidation and subsequent failure.

Figure 3:
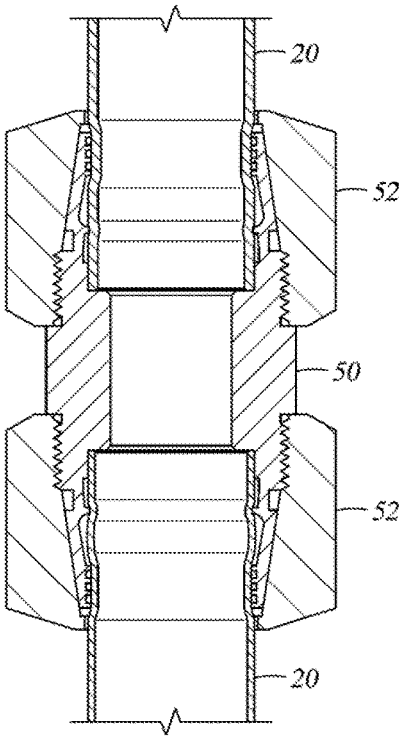
FIGS. 3 through 6 show various examples of a coupling to connect a TEC to a wellbore instrument housing.

FIG. 3 shows an example connection that may be used in some embodiments to couple the TEC 20 to the wellbore pump system (40 in FIG. 1). An internal compression fitting 50 may have features formed on an interior surface thereof such that when the TEC 20 is compressed axially, the TEC tube deforms radially to fit within the features as shown in FIG. 3. Axial compression may be performed using an external compression fitting 52. In the present example embodiment, the internal compression fitting 52 may be attached to the top of the wellbore pump system (40 in FIG. 1).

Figure 4:
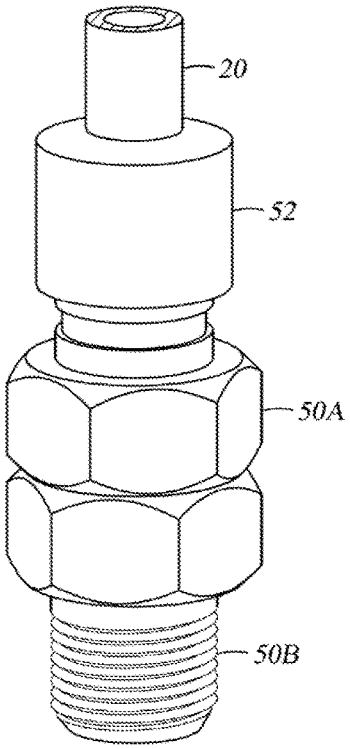

FIG. 4 shows another embodiment similar to the embodiment shown in FIG. 3, the difference being that the internal compression fitting 50A may have threads 50B at one longitudinal end rather than features for compression fir to the TEC 20. The threads 50B may engage corresponding threads (not shown) in the wellbore pump system (40 in FIG. 1).

Figure 5:
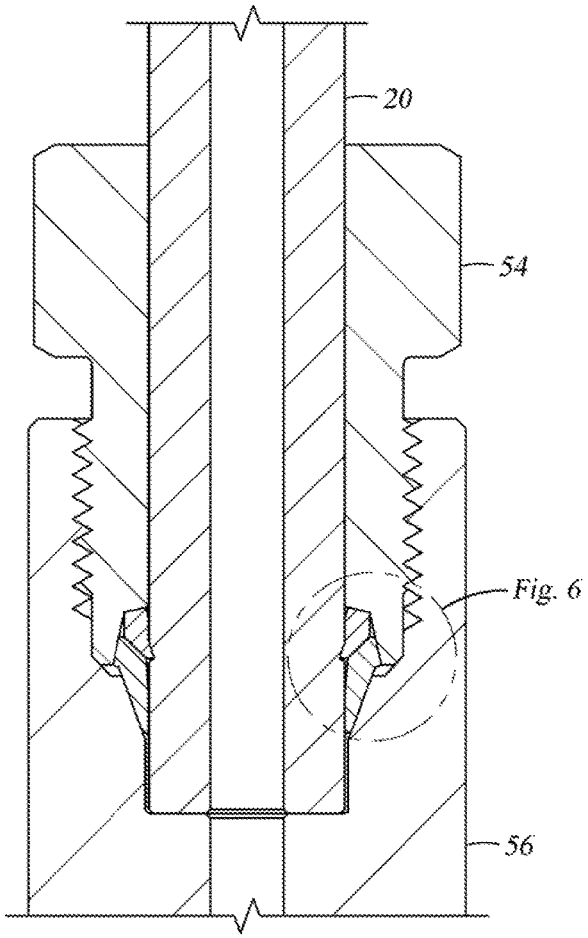
Figure 6:
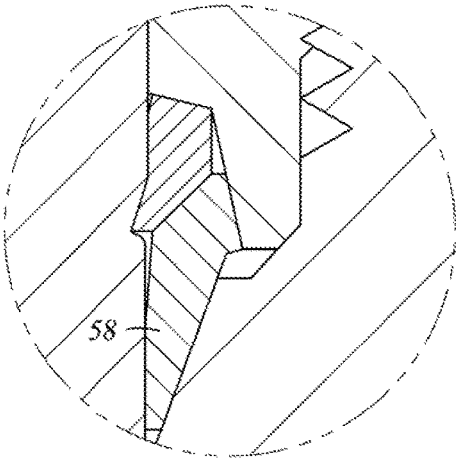

FIG. 5 shows another type of compression fitting 56 that may be used in some embodiments. The compression fitting 56 may include a tapered interior surface that include internal threads for engaging a compression nut 54. The compression nut 54 may be moved over the exterior of the TEC 20 and threaded to tighten the compression nut 54 in the compression fitting 54. A ferrule may be used in some embodiments to improve sealing between the compression fitting and the TEC 20. An enlarged view of the compression fitting is shown in FIG. 6 to illustrate the position of the ferrule 58.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for deploying an electrical load device in a wellbore, comprising:

electrically and mechanically coupling the electrical load device to a tubing encapsulated cable disposed on a winch; and extending the tubing encapsulated cable and the electrical load device into a wellbore drilled through a subsurface fluid producing formation;

wherein the tubing encapsulated cable consists of an outer tube which excludes fluid in the wellbore from an interior of the outer tube, the tubing encapsulated cable including one or more electrical conductors disposed inside the outer tube, wherein the electrical load device draws a steady state electrical current, a cross-sectional area of the one or more electrical conductors selected to provide the one or more electrical conductors with a rated electrical current which is lower than the steady state electrical current drawn by the electrical load device; and wherein the cross-sectional area is selected based on at least one of a velocity of a fluid within the wellbore, a heat capacity of the fluid, a temperature of the fluid and a thermal conductivity of the tubing encapsulated cable.

2. The method of claim 1 wherein the cross-sectional area of the one or more electrical conductors is equivalent to the cross sectional area of a circular conductor having a diameter of at most 0.0808 inches (2.05 millimeters).

3. The method of claim 1 wherein the cross-sectional area of the one or more electrical conductors is equivalent to the cross sectional area of a circular conductor having a diameter of at most 0.1019 inches (2.59 millimeters).

4. The method of claim 1, wherein the outer tube is made from a material selected to exclude fluid in the well bore from an interior of the outer tube.

5. The method of claim 1, wherein the electrical load device comprises an electric motor.

6. The method of claim 5 wherein the electric motor is a permanent magnet motor.

7. The method of claim 6 wherein the electric motor operates at a rotational speed of at least 5,400 revolutions per minute.

8. The method of claim 1 wherein the electrical load device comprises a wellbore pump system comprising a pump driven by an electric motor.

9. The method of claim 8 wherein an outer diameter of the well bore pump system is at most 4.5 inches (114.3 millimeters).

10. The method of claim 8 wherein the electric motor is mounted above the pump.

11. The method of claim 8 wherein the pump is a centrifugal pump.

12. The method of claim 8 wherein the pump is a positive displacement pump.

13. The method of claim 8 wherein the pump is a progressive cavity pump.

14. The method of claim 1 wherein an outer diameter of the tubing encapsulated cable is at most 0.55 inches (14 millimeters).

15. The method of claim 1 wherein the outer tube is made from stainless steel.

16. The method of claim 1 wherein the outer tube has a wall thickness of at most 0.068 inches (1.73 millimeters).

17. The method of claim 1, wherein the steady state electrical current drawn by the electrical load device is at least 125 percent of the rated current of the one or more electrical conductors.

18. The method of claim 1 wherein the steady state electrical current drawn by the electrical load device is at least 300 percent of the rated current of the one or more electrical conductors.

19. The method of claim 1, wherein the steady state electrical current drawn by the electrical load device is at least 6 amperes per square millimeter of conductor cross section area.

20. The method of claim 1, wherein the steady state electrical current drawn by the electrical load device is at least 10 amperes per square millimeter of conductor cross section area.

21. The method of claim 20, wherein the tubing encapsulated cable extends substantially continuously from the first end thereof to a surface end of the tubing encapsulated cable.

22. The method of claim 1 wherein a voltage applied to a surface end of the tubing encapsulated cable is at least 600 volts.

23. The method of claim 1 wherein a voltage applied to a surface end of the tubing encapsulated cable is at least 3,000 volts.

24. The method of claim 1, wherein the electrical load device is coupled to a first end of the tubing encapsulated cable.

25. The method of claim 1 wherein the cross-sectional area of the one or more electrical conductor is selected such that a temperature increase in air of the one or more electrical conductors resulting from the steady state electrical current would result in at least one of, (i) a decrease in elastic limit of one or more electrical conductors to below a tensile stress applied thereto, (ii) an oxidation of the one or more electrical conductor, and (iii) a thermal degradation of insulation on the one or more electrical conductor.

26. A wellbore system, comprising:

a downhole electrical load device for location within a wellbore drilled through a subsurface fluid producing formation, the downhole electrical load device drawing a predetermined continuous electrical current when operated; and a spoolable tubing encapsulated cable electrically and mechanically coupled to the downhole electrical load device, the tubing encapsulated cable extending from the downhole electrical load device in the wellbore to a surface end of the wellbore, wherein the tubing encapsulated cable consists of an outer tube which excludes fluid in the wellbore from an interior of the outer tube, the tubing encapsulated cable including one or more electrical conductors disposed inside the outer tube, wherein the one or more electrical conductors has a cross-sectional area selected to provide the one or more electrical conductors with a rated current which is lower than a steady state electrical current drawn by the electrical load device and wherein the cross-sectional area is selected based on at least one of a velocity of a fluid within the wellbore, a heat capacity of the fluid, a temperature of the fluid and a thermal conductivity of the cable.

* * * * *